US008378217B2

(12) United States Patent
Sugiyama et al.

(10) Patent No.: US 8,378,217 B2
(45) Date of Patent: Feb. 19, 2013

(54) DIFFERENTIAL SIGNAL CABLE, AND CABLE ASSEMBLY AND MULTI-PAIR DIFFERENTIAL SIGNAL CABLE USING THE SAME

(75) Inventors: Takahiro Sugiyama, Hitachi (JP); Hideki Nonen, Hitachi (JP); Yoshinori Tsukamoto, Hitachi (JP)

(73) Assignees: Hitachi Cable, Ltd., Tokyo (JP); Hitachi Cable Fine-Tech, Ltd., Ibaraki (JP)

( * ) Notice: Subject to any disclaimer, the term of this patent is extended or adjusted under 35 U.S.C. 154(b) by 188 days.

(21) Appl. No.: 12/889,746

(22) Filed: Sep. 24, 2010

(65) Prior Publication Data

US 2011/0232941 A1 Sep. 29, 2011

(30) Foreign Application Priority Data

Mar. 23, 2010 (JP) ..... 2010-065981

(51) Int. Cl.
*H01B 11/00* (2006.01)

(52) U.S. Cl. ..... 174/113 R; 174/115; 174/117 F

(58) Field of Classification Search ..... 174/113 R, 174/115, 117 F
See application file for complete search history.

(56) References Cited

U.S. PATENT DOCUMENTS

| | | | | |
|---|---|---|---|---|
| 5,283,390 | A * | 2/1994 | Hubis et al. | 174/36 |
| 5,334,271 | A * | 8/1994 | Bullock et al. | 156/51 |
| 6,403,887 | B1 * | 6/2002 | Kebabjian et al. | 174/110 R |

FOREIGN PATENT DOCUMENTS

| | | |
|---|---|---|
| JP | 2001-035270 | 2/2001 |
| JP | 2002-289047 | 10/2002 |
| JP | 2003-234024 | * 8/2003 |
| JP | 2003-346566 | 12/2003 |
| JP | 2007-026909 | 2/2007 |

* cited by examiner

*Primary Examiner* — Chau Nguyen
(74) *Attorney, Agent, or Firm* — Brundidge & Stanger, P.C.

(57) ABSTRACT

A differential signal cable for transmitting high-speed digital differential signals of several Gbit/s or more is provided to minimize characteristic impedance mismatch and to repress increase in the skew, or increase in disturbance due to differential-mode to common-mode conversion. A differential signal cable comprises two insulated wires arranged parallelly in a contact, each of said two insulated wires comprising a conductor and an insulator jacketing the conductor; a fusion layer provided on the surface of each of said two insulated wires; a drain wire placed longitudinally in a recess created in the interstice between said two insulated wires; and a shield tape lapping around said two insulated wires and said drain wire together, wherein a surface of said insulator of each of said two insulated wires is partially deformed so as to have a flat portion and said two insulated wires are fused each other at said flat portions.

8 Claims, 5 Drawing Sheets

DIFFERENTIAL SIGNAL CABLE, AND CABLE ASSEMBLY AND MULTI-PAIR DIFFERENTIAL SIGNAL CABLE USING THE SAME

The present application is based on Japanese Patent Application No. 2010-065981 filed on Mar. 23, 2010, the entire contents of which are incorporated herein by reference.

TECHNICAL FIELD

The present invention relates to a differential signal cable for transmitting high-speed digital signals of several Gbit/s or more over a distance from several meters to several ten meters with less degradation of signal waveforms. The present invention further relates to a cable assembly and a multi-pair differential signal cable each using such cable.

BACKGROUND OF THE INVENTION

In servers, routers, or storage devices that handle high-speed digital signals of several Gbit/s or more, a differential signal transmission system is employed for transmitting signals among such equipment or between circuit boards within such equipment. The differential signal transmission system transmits a signal in a two-phase style of signal on two conductors: one normal phase and the other 180-degree inverted phase. On the receiving end, the differential between the received two-phase signals are combined to be outputted. The directions of signal currents flowing along the two conductors are opposite each other; therefore, the electromagnetic wave that the transmission line may emit is small. Further, noise induced from the outside is superposed evenly on each of the two conductors; therefore, the effect of noise can be eliminated by combining the differential between them at the receiving end. For these reasons, high-speed digital signal transmission systems often use the differential signal.

As a differential signal cable to be used for transmitting differential signal, a twisted pair cable may be cited. The twisted pair cable is comprised of two insulated wires, which are conductors covered with insulator and twisted into a pair. The twisted pair cable is an economical cable with excellent circuit balance properties and is easy to bend; the cable therefore is used widely by preference for signal transmission over a medium distance. The twisted pair cable however has large signal attenuation. Because of this, a system that uses a twisted pair cable needs large electric power (about 6 to 10 times of that in a twinax cable as will be described later) for signal processing to compensate the signal attenuation. A twisted pair cable of a general style has no metallic layer thereon that will function as a shield. Therefore, the cable tends to be affected by the existence of a nearby-metallic body inviting a problem of unstable characteristic impedance of the cable. Further, the difference of the physical length between insulated conductors in a pair is large because the construction of the twisted pair cable is a strand of two insulated wires. Therefore, the effect of skew becomes large when the twisted pair cable is covered with a metallic conductor layer that works as a shield. Because of these, signals in the high-frequency region of several GHz tend to deform in their waveforms. Therefore, the twisted pair cable has been seldom used as a transmission line that is to convey signals with a rate of several Gbit/s.

On the other hand, there is a cable in which two insulated wires are arranged parallel without twisting and are covered with a shield (hereinafter referred to as a twinax cable). The twinax cable has smaller signal attenuation in the high-frequency range compared to twisted pair cables. Since a shield is provided over two insulated wires, the twinax cable is stable in its characteristic impedance even if a metallic body is placed close to the cable and the susceptibility to noise is low. Because of these advantages, the twinax cable has been used for transmission of relatively higher-speed signal over short distances. As the construction of the shield, tapes with conductive layer and coverings of braided wires are applied. Instead of covering with a shield, a drain wire may be incorporated.

For example, FIG. 5 is a sectional view of the twinax cable 50 disclosed in JP 2002-289047 A as an example of twinax cables, in which two insulated wires 533, each of which is a signal conductor 531 jacketed with an insulator 532, are lapped or longitudinally lapped with a shield tape 535, which is a laminate of a polyethylene tape 538 to which a metallic foil 537 such as aluminum is bonded. Between the shield tape 535 and the insulated wire 533, a drain wire 534 is arranged so that the drain wire will contact the metallic foil 537 of the shield tape 535, and is grounded.

FIG. 6 is a sectional view of an example of the twinax cable 60 disclosed in JP 2003-346566 A. Two insulated wires 633, each of which is a signal conductor 631 jacketed with an insulator 632, have fusion layers 636 severally thereon. Two insulated wires 633 are bonded mutually via the fusion layer 636 and covered with a shield tape 635, which is a laminate of a metallic foil 637 such as aluminum, applied over the bonded configuration. In the twinax cable 50 illustrated in FIG. 5, a positional deviation appears between the insulated wires 533 because of slipping caused by a repeated bending or similar handling of the cable. In the twinax cable 60 illustrated in FIG. 6, no slipping occurs in contrast since the insulated wires 633 are mutually fused. It is indicated in the literature that the skew, which is the difference of signal propagation time between two signal conductors, will be reduced by such configuration. Increased skew deforms the digital signal waveform obtained by combining the signal differentials at the receiving end. As a result of this, the signal quality degrades even if the skew is several pico seconds when a transmission system handles high-speed signals of 10 Gbit/s or equivalent rate.

FIG. 7 is a sectional view of an example of the twinax cable 70 disclosed in JP 2001-035270 A. Signal conductors 731 are overall-jacketed with an insulator 732 and lapped or longitudinally lapped with a shield tape 735, which is comprised of a metallic foil tape.

FIG. 8 is a sectional view of an example of the twinax cable 80 disclosed in JP 2007-026909 A. Insulated wires 833 are covered with a foamed tape 839 and covered with a shield tape with a drain wire 834 longitudinally placed on the foamed tape 839.

SUMMARY OF THE INVENTION

Twinax cables are generally used for transmission of high-speed differential signals of several Gbit/s where distance is 1 to 10 meters or so. Both ends of a twinax cable have connectors installed thereon, each of which mates with a connector receptacle on equipment for eased connection. Inside the connector, a miniature printed circuit board of a card-edge type having plural contacts is installed. The miniature printed circuit board is about 0.5 to 1 mm in thickness. In installing the connector on the twinax cable is therefore performed in such a manner that the conductor of the cable is terminated on the signal circuitry face of the printed circuit board and the drain wire is on the grounding face on the other face of the board.

In the transmission of high-speed signals of several Gbit/s, characteristic impedance must be maintained uniform as much as possible; otherwise, undesirable signal reflection will appear causing degradation in signal quality. Uniformity of characteristic impedance is easily disturbed particularly at the junction point between the twinax cable and the printed circuit board, because such junction point is discontinuous in physical constructions: one is a cable-style in cross-section and the other is a micro-strip line. This constructional discontinuity easily generates signal reflection due to deviation of characteristic impedance. Further to the above, the physical construction must be such a configuration as reduces the skew. This consequently requires the cable construction not to cause positional deviation of the insulated wires from their original position and of the drain wire when the cable is bent.

In such a conventional cable construction as is illustrated in FIG. 5, the drain wire 534 is arranged in an interstice (recess) created between two insulated wires. For the cables for high-speed transmission over a distance between 1 m and 10 m, conductors of No. 24 American Wire Gauge (#24 AWG) are used most generally. In a typical cable design of the #24 AWG wire, the diameter of conductor $d_1$ is 0.51 mm, the thickness of insulator is 0.445 mm, and consequently the diameter of insulated wire $d_2$ is 1.4 mm. Where the diameter of conductor of the drain wire $d_3$ is assumed to be 0.40 mm, the distance r between the conductor of the insulated wire and the drain wire across the cable thickness is approximately 0.11 mm as given geometrically by the formula (1) following the schematic illustration given in FIG. 9.

{Equation 1}

$$r = \sqrt{\left(\frac{d_2}{2} + \frac{d_3}{2}\right)^2 - \left(\frac{d_2}{2}\right)^2} - \left(\frac{d_1}{2} + \frac{d_3}{2}\right) \quad (1)$$

In terminating this cable on a printed circuit board having a board thickness of about 0.5 mm, soldering the conductors on the signal terminal pads on the wiring face of the printed circuit board without bending requires the drain wire 534 to be bent by about 0.4 mm in the board-thickness direction to widen the distance from the conductor for soldering on a land 512 of grounding face (a pad for grounding terminal), as illustrated in FIG. 10. Under this condition, the drain wire 534 is forced to be bent from the point where the shield tape 535 is removed and to the point where the drain wire 534 is to be soldered. Further, since the bending cannot be sharp, a space is produced between the end of the insulator 532 and the printed circuit board 510. As a result of this, the characteristic impedance of this junction portion deviates to higher impedance causing undesired signal reflection with the signal transmission quality degraded. Moreover, the positional stability of a portion of the drain wire 534 in the produced space becomes unstable, inviting increase in the skew or degradation in differential-mode to common-mode conversion properties because of such as positional deviation.

The cables of conventional type for differential signal transmission illustrated in FIGS. 6 to 8 (twinax cables 60, 70, and 80) have measures for reducing occurring positional deviation of two insulated wires. In the twinax cable 60, two insulated wires 633 are fused each other (FIG. 6); in the twinax cable 70, conductors 731 and 732 are jacketed by overall extrusion (FIG. 7); and in the twinax cable 80, two insulated wires 833 are lapped with the foamed tape 839. In the case of the twinax cable 60 illustrated in FIG. 6 however, connecting the drain wire 634 is required to still be bent similarly as explained in FIG. 10, because the position of the drain wire in the cable is the same as in the conventional art illustrated in FIG. 5. Therefore, the characteristic impedance of the junction portion deviates to higher impedance causing undesired signal reflection with the signal transmission quality degraded. Further, the positional stability of a portion of the drain wire 634 in a produced space like in the case of the twinax cable 50, becomes unstable, inviting increase in the skew or degradation in differential-mode to common-mode conversion properties because of such as positional deviation.

In the case of the twinax cable 70 illustrated in FIG. 7, it is difficult to form a recess for accommodation of a drain wire. Without the accommodation recess, the position of the drain wire is unstable. Therefore, such situation causes positional deviation inviting increase in the skew or degradation in differential-mode to common-mode conversion properties. Further, it is also difficult to attain a desired positional accuracy of physical separation between two conductors.

In the case of the twinax cable illustrated in FIG. 8, the drain wire 834 is positioned relatively apart from signal conductors 831 compared to other differential signal cables (twinax cables 50, 60, and 70). Since the drain wire 834 is located outside the foamed tape 839, the drain wire 834 does not stably sit in place either. Therefore, such configuration causes positional deviation inviting increase in the skew or degradation in differential-mode to common-mode conversion properties. Moreover, the twinax cable 80 illustrated in FIG. 8 needs a lapping process of the foamed tape 839.

The present invention has been made in view of above-stated problems. It is therefore an object of the present invention to provide a differential signal cable for transmitting high-speed digital differential signals of several Gbit/s or more that permits minimizing characteristic impedance mismatch, which may appear when connecting to a device such as a printed circuit board having a built-in connector, at the connection point between the cable and such printed circuit board, and that at the same time represses increase in the skew, which is the difference of signal propagation time, or increase in disturbance due to differential-mode to common-mode conversion (degradation in differential-mode to common-mode conversion properties); and to provide a cable assembly and a multi-pair differential signal cable both using the same.

MEANS FOR SOLVING THE PROBLEMS

The present invention has been made to attain the above-stated object. The invention is a differential signal cable, comprising: two insulated wires arranged parallelly in a contact, each of the two insulated wires comprising a conductor and an insulator jacketing the conductor; a fusion layer provided on the surface of each of the two insulated wires; a drain wire placed longitudinally in a recess created in the interstice between the two insulated wires; and a shield tape lapping around the two insulated wires and the drain wire together, wherein a surface of the insulator of each of the two insulated wires is partially deformed so as to have a flat portion and the two insulated wires are fused each other at the flat portions.

The flat portion may have a width larger than the radius of the insulated wire.

The insulator may comprise a foamed material and each of the two insulated wires should preferably be fused each other through a heat-melt of the fusion layer.

The fusion layer comprises the same material as the insulator having a degree of foaming lower than that of the insulator.

The drain wire may be placed in each of two recesses created in the interstice between the two insulated wires.

The present invention is a cable assembly comprising a differential signal cable and a connector having a built-in printed circuit board connected to the end of the differential signal cable, wherein: the differential signal cable comprises two insulated wires arranged parallelly in a contact, each of the two insulated wires comprising a conductor and an insulator jacketing the conductor, a fusion layer provided on the surface of each of the two insulated wires, a drain wire placed longitudinally in a recess created in the interstice between the two insulated wires, and a shield tape lapping around the two insulated wires and the drain wire together; the conductor is connected to one face of the printed circuit board and the drain wire is connected to the other face of the printed circuit board; a surface of the insulator of each of the two insulated wires is partially deformed so as to have a flat portion and the two insulated wires are fused each other at the flat portions; and a differential between a distance from the conductor to the drain wire across the cable thickness and a thickness of the printed circuit board is reduced.

The distance between the conductor and the drain wire across the cable thickness may be made approximately equal to the thickness of the printed circuit board.

The flat portion may have a width larger than the radius of the insulated wire.

The insulator may comprise a foamed material and each of the two insulated wires may be fused each other through a heat-melt of the fusion layer.

The fusion layer may comprise the same material as the insulator having a degree of foaming lower than that of the insulator.

The drain wire may be placed in each of two recesses created in the interstice between the two insulated wires.

The present invention is a multi-pair differential signal cable, comprising: a strand of a plurality of the differential signal cables; a shield layer of braided conductors provided over the strand; and a jacket provided over the shield layer.

The present invention provides a differential signal cable for transmitting high-speed digital differential signals of several Gbit/s or more that permits minimizing characteristic impedance mismatch, which may appear when connecting to a device such as a printed circuit board having a built-in connector, at the connection point between the cable and such printed circuit board, and that at the same time represses increase in the skew, which is the difference of signal propagation time, or increase in disturbance due to differential-mode to common-mode conversion (degradation in differential-mode to common-mode conversion properties).

DETAILED DESCRIPTION OF THE PREFERRED EMBODIMENTS

The following explains a preferred embodiment of the present invention referring to drawings attached.

Figure 1:
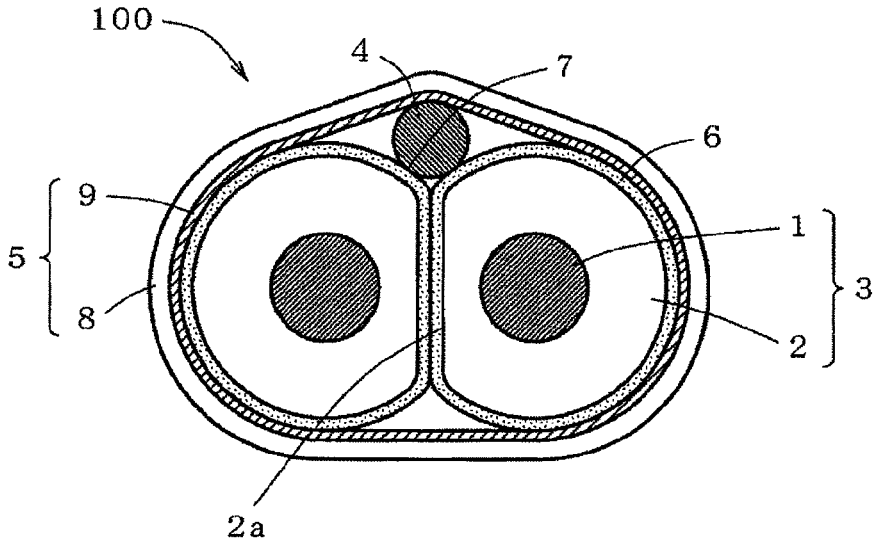
FIG. 1 is a sectional view of a differential signal cable of an embodiment of the present invention.

FIG. 1 is a sectional view of a differential signal cable of an embodiment of the present invention.

As illustrated in FIG. 1, a differential signal cable 100 in an embodiment of the present invention is comprised of two insulated wires 3, each of which is comprised of a signal conductor 1 and an insulator 2 jacketing the conductor 1, arranged parallelly in an intimate contact; a fusion layer 6 provided on the surface of each of the two insulated wires 3; a drain wire 4 placed longitudinally in a recess 7 created in the interstice between the two insulated wires 3; and a shield tape 5 lapping around the two insulated wires 3 and the drain wire 4 together.

The insulated wire 3 is formed by jacketing the conductor 1 with the insulator 2 supplied from an extruder.

As the conductor 1 for the insulated wire 3, a solid wire or stranded wires of good electrical conductor such as copper, or plated one, is used.

As the insulator 2, such a material as has small dielectric constant and dielectric tangent is preferable. For example, foamed material is feasible for such use. A method for forming the insulator 2 includes a method in which foaming agent is kneaded thereinto before forming process and the degree of foaming is controlled by the forming temperature, and a method in which nitrogen gas is injected thereinto at a forming pressure and foams are created by releasing the pressure.

On the surface of the insulated wire 3, the fusion layer 6 is applied. The fusion layer 6 is formed by, for example, covering with the same material as the insulator 2 with its degree of foaming suppressed low.

The drain wire 4 uses, similarly as in the case of the signal conductor 1, a solid wire or stranded wires of good electrical conductor such as copper, or plated one.

The shield tape 5 is a laminate of a polyethylene (PET) tape 8 to which a metal foil 9 is bonded. The shield tape 5 is applied in a manner winding around or lapping longitudinally with its metallic face, the metal foil 9, contacted with the drain wire 4.

In the differential signal cable 100 of this embodiment meantime, the two insulated wires 3, part of the insulator surface of each of which is deformed so as to have a flat portion 2*a*, are fused each other at the flat portions 2*a*.

Now, details of this construction will be explained together with a manufacturing method of the differential signal cable 100.

Figure 2:
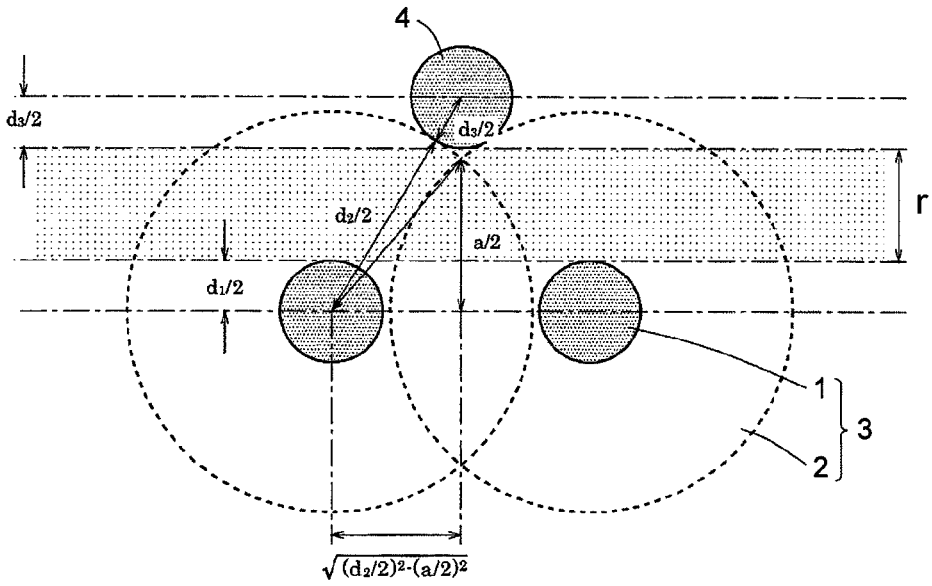
FIG. 2 is a sectional view of arrangement of the drain wire in the differential signal cable illustrated in FIG. 1.

The signal conductor 1 is jacketed with the insulator 2 to form the insulated wire 3, on which the fusion layer 6 is applied. Two insulated wires 6, each applied with the fusion layer 6 thereon, are arrayed in parallel and paid off at a constant speed to undergo heating while being pressed in right-left directions to be arrayed at a desired separation pitch. The pressing and heating process causes the fusion layers 6 formed on the surfaces of the insulated wires 3 to be surface-fused each other. In this process, the pressing force is controlled to a proper degree so that the insulated wires 3 will fuse each other with a fusion-width (the vertical dimension in the figure) larger than the radius of the insulated wire 3. This means that the fused-face between two insulated wires 3 has such a width that the central angle of the width with respect to the insulated wire 3 is 60 degrees or more. The temperature and the pressing force are returned to the initial state after the fusion and then the foams in the insulator 2 return to the initial shape, but the section-shape illustrated in FIG. 1 is retained since the fused portion does not separate. The drain wire 4 is longitudinally arranged in the recess 7 created as a consequence of fusion. Over the fused two insulated wires 3 and the drain wire 4 arranged longitudinally, the shield tape 5, which is a laminate of the polyethylene (PET) tape 8 to which the metal foil 9 is bonded, is wound around to secure the physical configuration.

Where a #24 AWG wire is used as the signal conductor 1, the diameter of conductor $d_1$ is 0.51 mm. Let us assume with this conductor that the diameter of the insulated wire 3 $d_2$ is 1.4 mm and that the diameter of the drain wire 4 $d_3$ is 0.40 mm. Following this assumption, the fusion is formed so that the fusion-width a will be half the diameter of the insulated wire 3, which is 0.7 mm. In this configuration, the thickness-wise distance r between the conductor and the drain wire is geometrically given using the formula (2) as illustrated in FIG. 2, which is about 0.21 mm.

{Equation 2}

$$r = \sqrt{\left(\frac{d_2}{2} + \frac{d_3}{2}\right)^2 - \left(\left(\frac{d_2}{2}\right)^2 - \left(\frac{a}{2}\right)^2\right)} - \left(\frac{d_1}{2} + \frac{d_3}{2}\right) \quad (2)$$

The depth of the recess 7 created both sides of the fused-face is 0.21 mm, which is deep enough for retaining the drain wire 4.

Where the fusion-width a is 1.0 mm using the same insulated wire 3 and the drain wire 4 as described above, the thickness-wise distance r between the conductor and the drain wire becomes approximately 0.30 mm.

Next, the cable assembly, which is a cable assembly comprised of the differential signal cable 100 of this embodiment and a connector installed on the end thereof, will be explained together with installation method therefor referring to FIG. 3.

Figure 3:
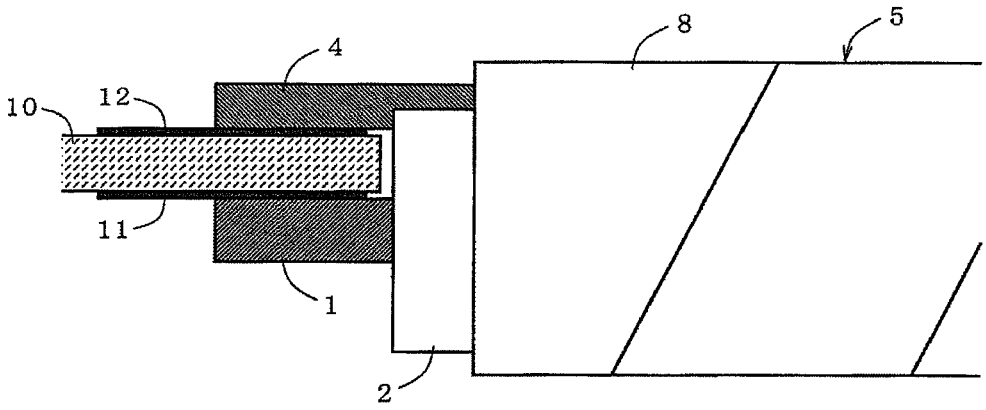
FIG. 3 is a side view of an aspect of the mounting of the differential signal cable illustrated in FIG. 1 on a printed circuit board.

The cable end is treated as illustrated in FIG. 3. The shield tape 5 is removed with a dedicated cutter or laser irradiation. The insulator 2 is also removed in a tiered-cut style to expose the signal conductor 1 and the drain wire 4. The conductor 1 for signal transmission and the drain wire 4 thus exposed are fixed and soldered respectively on a signal terminal pad 11 and a grounding terminal pad 12 on a printed circuit board 10 incorporated in a connector (not illustrated) to establish connections. In this connection configuration, connecting the differential signal cable 100, of which signal conductor 1 is a #24 AWG wire, to a printed circuit board 10 having thickness of about 0.5 mm requires the drain wire 4 to be bent in the board-thickness direction. When, for example, the fusion-width a is 1.0 mm as assumed in the above description, the thickness-wise distance r between the conductor and the drain wire can be made approximately 0.30 mm. It is therefore enough for the widening of distance to bend the drain wire 4 by about 0.2 mm in the board-thickness direction. Consequently, the removal length of the shield tape 5 can be shortened with degradation of the transmission properties reduced.

The differential signal cable 100 of this embodiment permits each conductor and wire to be soldered without bending, with their insulator or jacket as-removed; further, the removal length of the shield tape 5 is made short with degradation of the transmission properties reduced. Further, the insulated wires 3 are fixed mutually by fusion. Therefore, the physical configuration of the cable is stable against bending and the positional deviation of the drain wire 4 is hard to occur. Thus, it becomes feasible to realize a cable that offers in its entirety small skew, much stability, and less degradation in transmission properties. In addition, since the insulated wires 3 are bonded mutually by fusion of the fusion layers 6 rendered by heating, the insulators 2 are deformed with their surface bonded. Consequently, no foams will be crushed even if foaming material is used as the insulator 2, because it is not that the deformation occurs with the insulators 2 pressed. Therefore, the sizes of foams in the insulator 2 are uniform for every portion thereof after the heating was released. This means that the foams in the insulator 2 for deformed portion and for other portion are approximately same in size. Because of this, the dielectric constant of the transmission line is almost uniform and the dispersion that would occur on propagation is small with the skew minimized.

In short, the differential signal cable 100 of this embodiment can make the thickness-wise distance r between the conductor and the drain wire longer even though the insulated wires 3 are given the same diameters as the conventional ones. This configuration, when the differential signal cable 100 is connected to a connector to form a cable assembly, makes uniformity of the distance between the signal conductor 1 and the drain wire 4 undisturbed at the connection point between the differential signal cable 100 and the connector to a practicably utmost extent. Therefore, a change in characteristic impedance hardly occurs with reduced degradation of the transmission properties.

In this embodiment, the drain wire 4 is provided in one of two recesses created between two insulated wires 3; however, two drain wires may be severally placed in both the recesses.

Figure 4:
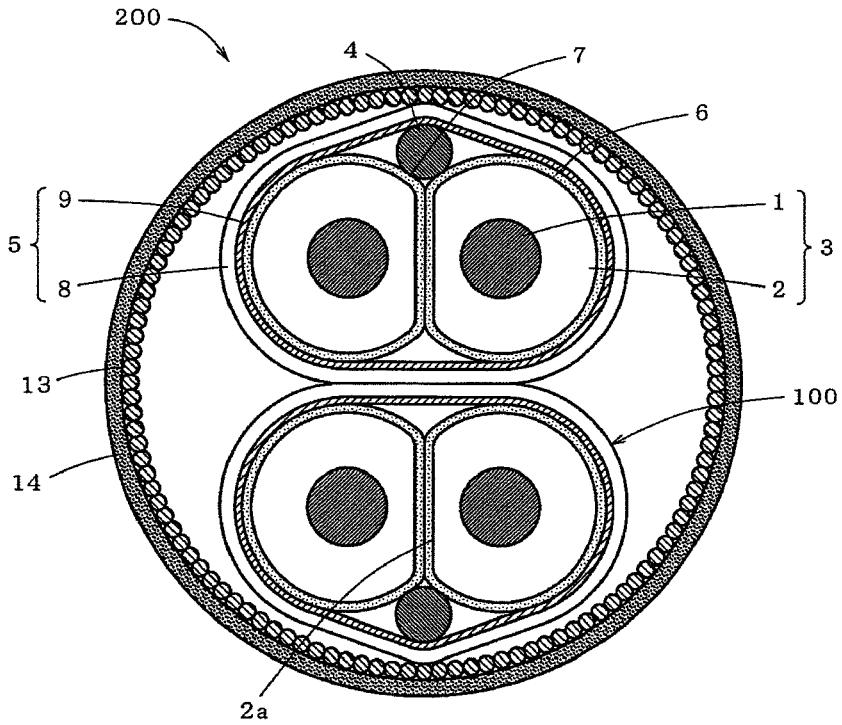
FIG. 4 is a sectional view of a multi-pair differential signal cable in an embodiment of the present invention.
Figure 5:
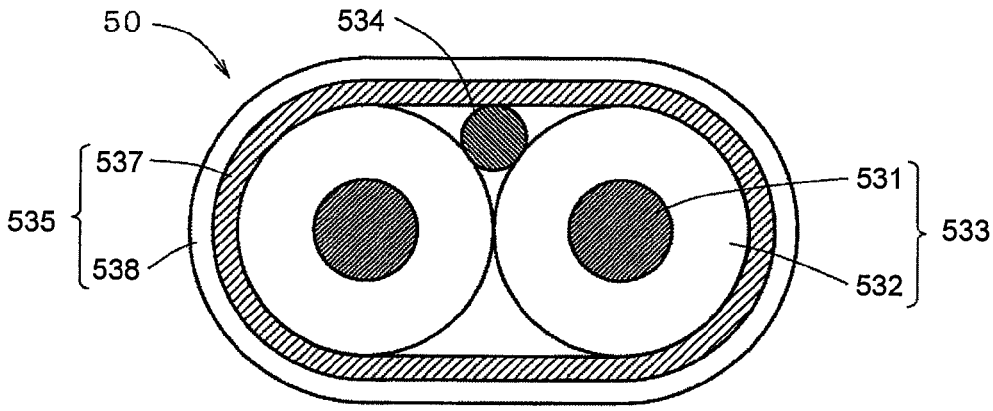
FIG. 5 PRIOR ART
FIG. 5 is a sectional view of a conventional differential signal cable.
Figure 6:
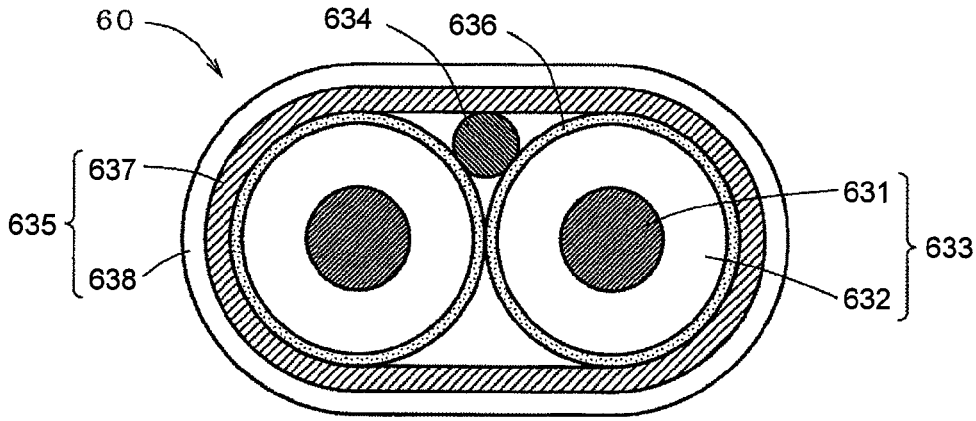
FIG. 6 PRIOR ART
FIG. 6 is a sectional view of a conventional differential signal cable.
Figure 7:
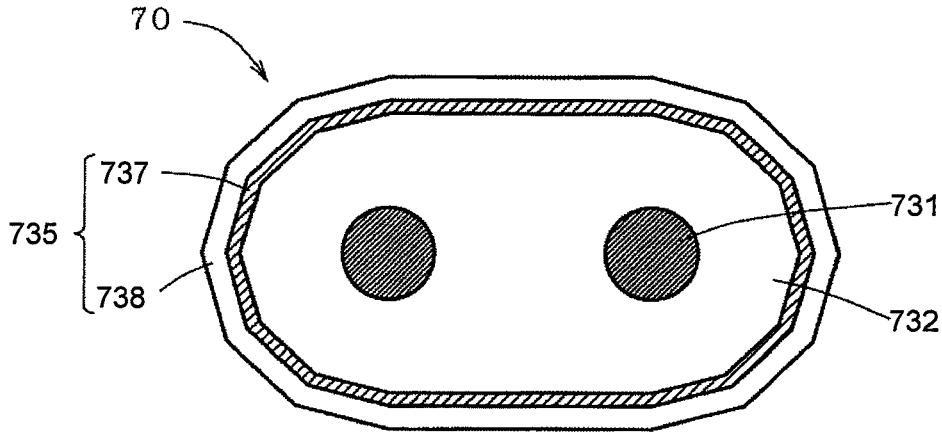
FIG. 7 PRIOR ART
FIG. 7 is a sectional view of a conventional differential signal cable.
Figure 8:
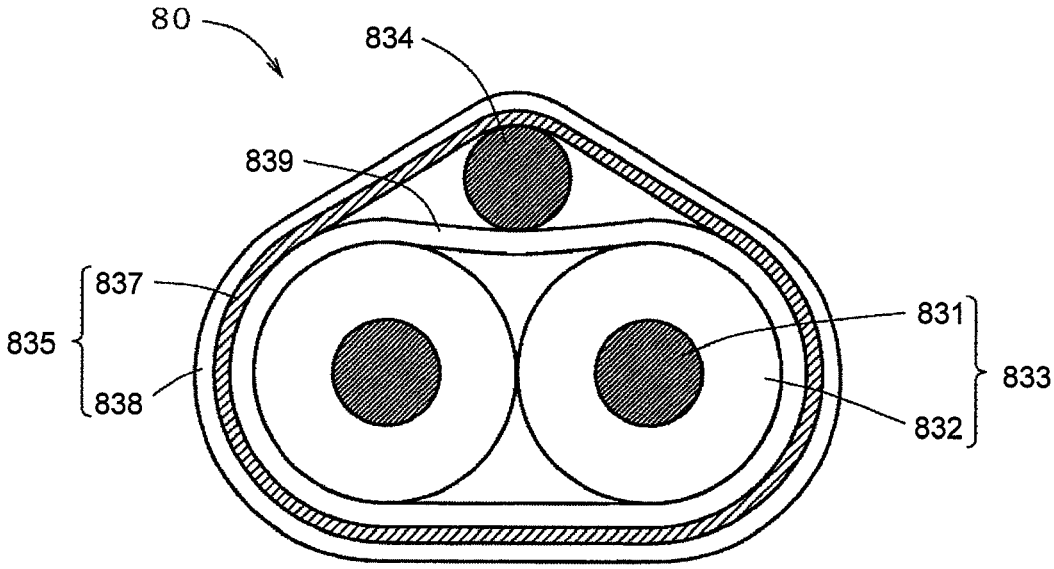
FIG. 8 PRIOR ART
FIG. 8 is a sectional view of a conventional differential signal cable.
Figure 9:
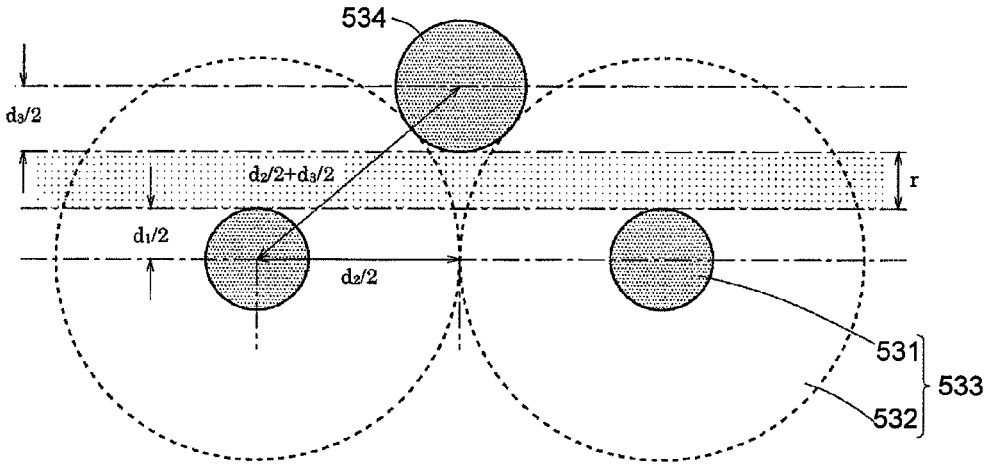
FIG. 9 PRIOR ART
FIG. 9 is a sectional view of arrangement of the drain wire in the differential signal cable illustrated in FIG. 5.
Figure 10:
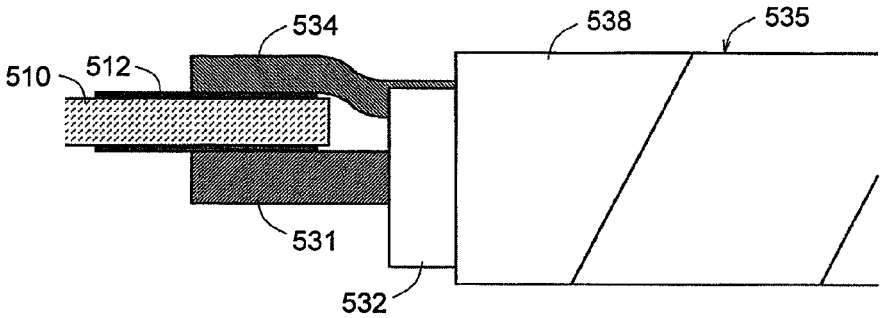
FIG. 10 PRIOR ART
FIG. 10 is a side view of an aspect of the mounting of the differential signal cable illustrated in FIG. 5 on a printed circuit board.

FIG. 4 is a sectional view of a multi-pair differential signal cable of an embodiment of the present invention.

As illustrated in FIG. 4, a multi-pair differential signal cable 200 of an embodiment of the present invention is comprised of two differential signal cables 100. The differential signal cable 100 is, as illustrated in FIG. 1, comprised of the insulated wire 3 comprised of the signal conductor 1 and the insulator 2; the drain wire 4; and the shield tape 5. Two differential signal cables 100 are stranded so as not to separate, covered with a shielding layer 13 comprised of braided conductors to cutoff external noise, and sheathed with a jacket 14 for cable protection.

The multi-pair differential signal cable 200 of this embodiment has two differential signal cables 100 one for the sending the other for the receiving and is provided with the shielding layer 14 as a measure against the external noise. Therefore, it is feasible to realize a higher transmission speed with this cable compared to the differential signal cable 100 illustrated in FIG. 1.

The invention claimed is:

1. A differential signal cable, comprising;

two insulated wires arranged parallelly in a contact, each of said two insulated wires comprising a conductor and an insulator jacketing the conductor;

a fusion layer provided on the surface of each of said two insulated wires;

a drain wire placed longitudinally in a recess created in the interstice between said two insulated wires; and a shield tape lapping around said two insulated wires and said drain wire together, wherein a surface of said insulator of each of said two insulated wires is partially deformed so as to have a flat portion and said two insulated wires are fused to each other at said flat portions, wherein said insulator comprises a foamed material and said two insulated wires are fused to each other through a heat-melt of said fusion layer, and wherein said fusion layer comprises the same material as said insulator having a degree of foaming lower than that of said insulator.

2. The differential signal cable according to claim 1, wherein said flat portion has a width larger than the radius of said insulated wire.

3. The differential signal cable according to claim 1, wherein said drain wire is placed in each of two recesses created in the interstice between said two insulated wires.

4. A cable assembly comprising:

a differential signal cable and a connector having a built-in printed circuit board connected to the end of said differential signal cable, wherein said differential signal cable comprises two insulated wires arranged parallelly in a contact, each of said two insulated wires comprising a conductor and an insulator jacketing said conductor, a fusion layer provided on the surface of each of said two insulated wires, a drain wire placed longitudinally in a recess created in the interstice between said two insulated wires, and a shield tape lapping around said two insulated wires and said drain wire together, and wherein said conductor is connected to one face of said printed circuit board and said drain wire is connected to the other face of said printed circuit board;

a surface of said insulator of each of said two insulated wires is partially deformed so as to have a flat portion and said two insulated wires are fused to each other at said flat portions; and a differential between a distance from said conductor to said drain wire across the cable thickness and a thickness of said printed circuit board is reduced, wherein said insulator comprises a foamed material and each of said two insulated wires is fused to each other through a heat-melt of said fusion layer, and wherein said fusion layer comprises the same material as said insulator has a degree of foaming lower than that of said insulator.

5. The cable according to claim 4, wherein said flat portion has a width larger than the radius of said insulated wire.

6. The cable assembly according to claim 4, wherein said drain wire is placed in each of two recesses created in the interstice between said two insulated wires.

7. A cable assembly comprising:

a differential signal cable and a connector having a built-in printed circuit board connected to the end of said differential signal cable, wherein said differential signal cable comprises two insulated wires arranged parallelly in a contact, each of said two insulated wires comprising a conductor and an insulator jacketing said conductor, a fusion layer provided on the surface of each of said two insulated wires, a drain wire placed longitudinally in a recess created in the interstice between said two insulated wires, and a shield tape lapping around said two insulated wires and said drain wire together, wherein said conductor is connected to one face of said printed circuit board and said drain wire is connected to the other face of said printed circuit board;

a surface of said insulator of each of said two insulated wires is partially deformed so as to have a flat portion and said two insulated wires are fused each other at said flat portions; and a differential between a distance from said conductor to said drain wire across the cable thickness and a thickness of said printed circuit board is reduced, wherein the distance between said conductor and said drain wire across the cable thickness is approximately equal to the thickness of said printed circuit board.

8. A multi-pair differential signal cable, comprising:

a strand of a plurality of differential signal cables comprising two insulated wires arranged parallelly in a contact, each of said two insulated wires comprising a conductor and an insulator jacketing said conductor, a fusion layer provided on the surface of each of said two insulated wires, a drain wire placed longitudinally in a recess created in the interstice between said two insulated wires, and a shield tape lapping around said two insulated wires and said drain wire together, in which a surface of said insulator of each of said two insulated wires is partially deformed so as to have a flat portion and said two insulated wires are fused each other at said flat portions;

a shielding layer of braided conductors provided over said strand; and a jacket provided over said shielding layer, wherein said insulator comprises a foamed material and said two insulated wires are fused to each other through a heat-melt of said fusion layer, and wherein said fusion layer comprises the same material as said insulator having a degree of foaming lower than that of said insulator.

* * * * *